US006634774B2

(12) United States Patent
Redding

(10) Patent No.: US 6,634,774 B2
(45) Date of Patent: Oct. 21, 2003

(54) MARINE BRAKE LIGHT SYSTEM

(76) Inventor: Leslie Redding, 6054 Johnson Rd. NW., Hahira, GA (US) 31632

( * ) Notice: Subject to any disclaimer, the term of this patent is extended or adjusted under 35 U.S.C. 154(b) by 281 days.

(21) Appl. No.: 09/951,063

(22) Filed: Jun. 12, 2001

(65) Prior Publication Data

US 2002/0172051 A1 Nov. 21, 2002

Related U.S. Application Data

(60) Provisional application No. 60/292,905, filed on May 21, 2001.

(51) Int. Cl.[7] ..... B60Q 1/00

(52) U.S. Cl. ..... 362/477; 362/276; 362/802; 340/984

(58) Field of Search ..... 362/464, 477, 362/191, 276, 802; 340/984

(56) References Cited

U.S. PATENT DOCUMENTS 4,884,173 A * 11/1989 Cassidy ..... 362/477
5,537,299 A * 7/1996 Perry ..... 362/477
5,636,916 A 6/1997 Sokolowski
6,200,009 B1 * 3/2001 Schulte ..... 362/477
6,473,005 B2 * 10/2002 Showell ..... 340/984

* cited by examiner

*Primary Examiner*—Sandra O'Shea
*Assistant Examiner*—Peggy A Neils
(74) *Attorney, Agent, or Firm*—Brian D. Bellamy

(57) ABSTRACT

The present invention provides a marine warning light system for a motorboat having an outboard marine engine. The system includes securing a warning light facing aft on the outboard motor. A switch is adapted to the throttle control assembly located on the outboard motor that controls the speed of the operation of the throttle and the speed of the motorboat. As the throttle control assembly is operated, a position sensing device, such as a lever, provides feedback from the throttle control assembly to the switch and causes the switch to activate and close a circuit from a power source to energize the warning light upon the throttle control assembly moving to slow or stop the motorboat. The position sensing device may consist of a lever that lifts when it contacts a trunnion on the throttle control assembly when in the forward accelerated operating position. The switch is activated to warn boats in the vicinity behind the motorboat when slowing or stopped.

6 Claims, 2 Drawing Sheets

MARINE BRAKE LIGHT SYSTEM

This application claims the benefit of U.S. Provisional Application No. 60/292,905, filed May 21, 2001.

BACKGROUND OF THE INVENTION

The present invention relates to an improved lighting system for boats and more particularly to a brake light system used with an outboard marine engine to warn boats in the vicinity when the boat ahead is slowing or stopped.

The increasing popularity of fishing and boating has created a substantial need for improved safety in boating. In particular, a warning light system is needed for boats to warn other boaters when that boat is slowing or stopping. This is especially important for people who use their boats during twilight and nighttime hours. Many events involving boating taken place during such twilight are nighttime hours, in particular fishing tournaments and hunting. In fishing tournaments, boaters often line up during early morning hours to take turns racing to their favorite fishing location. During the line up, boats are often idling in very close proximity to each other awaiting their signal to accelerate. A significant danger to these boaters is that the boater ahead will not accelerate as expected or will suddenly slow or stop causing an accident. The darkness and fog of early morning causes limited visibility which further promotes the danger of collision.

In another boating activity referred to sometimes as cruising, boaters will trail along in a line front to rear at a reasonable speed for traveling a waterway. However, large wakes, obstructions, mechanical problems, or other demands may cause a boat in the line to need to slow or stop. If a trailing boater is not paying close attention, the boater may not perceive that the boat ahead has changed speed and realize the need to slow or change course. Thus, even further need exist for a system to warn other boaters with a boat ahead is slowing or stopping.

Systems such as the Boat Safety Lighting Apparatus and Method of Using Same in U.S. Pat. No. 5,636,916 to Sokolowski have been provided to give information to boaters about the position of a boat having the lighting system. Sokolowski teaches the use of a lighting system mounted on a boat to indicate whether the transmission direction of a boat is head on, away from, or turning with respect to the observing boat. However, the Sokolowski prior art has not taught a simple system of providing a brake warning light for outboard engine motor boats that is easily adaptable to most boats having outboard engines and will indicate when a boat is slowing.

SUMMARY OF THE INVENTION

The present invention provides a brake light that is mountable on the rear of an outboard marine engine. An electrical switch operates in conjunction with the throttle of the outboard motor to actuate the warning light when the throttle is closed near neutral causing the brake light to energize and provide a signal. A typical outboard motor throttle includes a cylindrical trunnion that may be used to actuate the switch when the throttle is opened or closed. When the throttle is closed or near closed the trunnion will allow the electrical switch to activate. Whereas, when the throttle is open beyond a critical point, the electrical switch will close as the boat accelerates or continues to travel at a reasonably fast speed.

The boater may operate the throttle by the throttle control lever. Therefore, the warning light may be illuminated by moving the lever from a forward position providing accelerated boat operation toward a neutral or near neutral position providing slower boat operation.

Therefore a first object of the present invention is to provide a simple warning light system adaptable for use in outboard marine engines which includes a mounting member for mounting a bright warning light to the top of an outboard engine facing rearward from the stern of the boat.

It is a further object of the invention to provide an outboard motorboat warning light system that is inexpensive to construct and that adapts to an existing outboard marine engine using a minimal number of new parts.

It is a further object of the invention to provide a warning light that indicates to a boater behind another boater when the leading boater is slowing or stopping.

DETAILED DESCRIPTION OF THE INVENTION

Figures 1, 2:
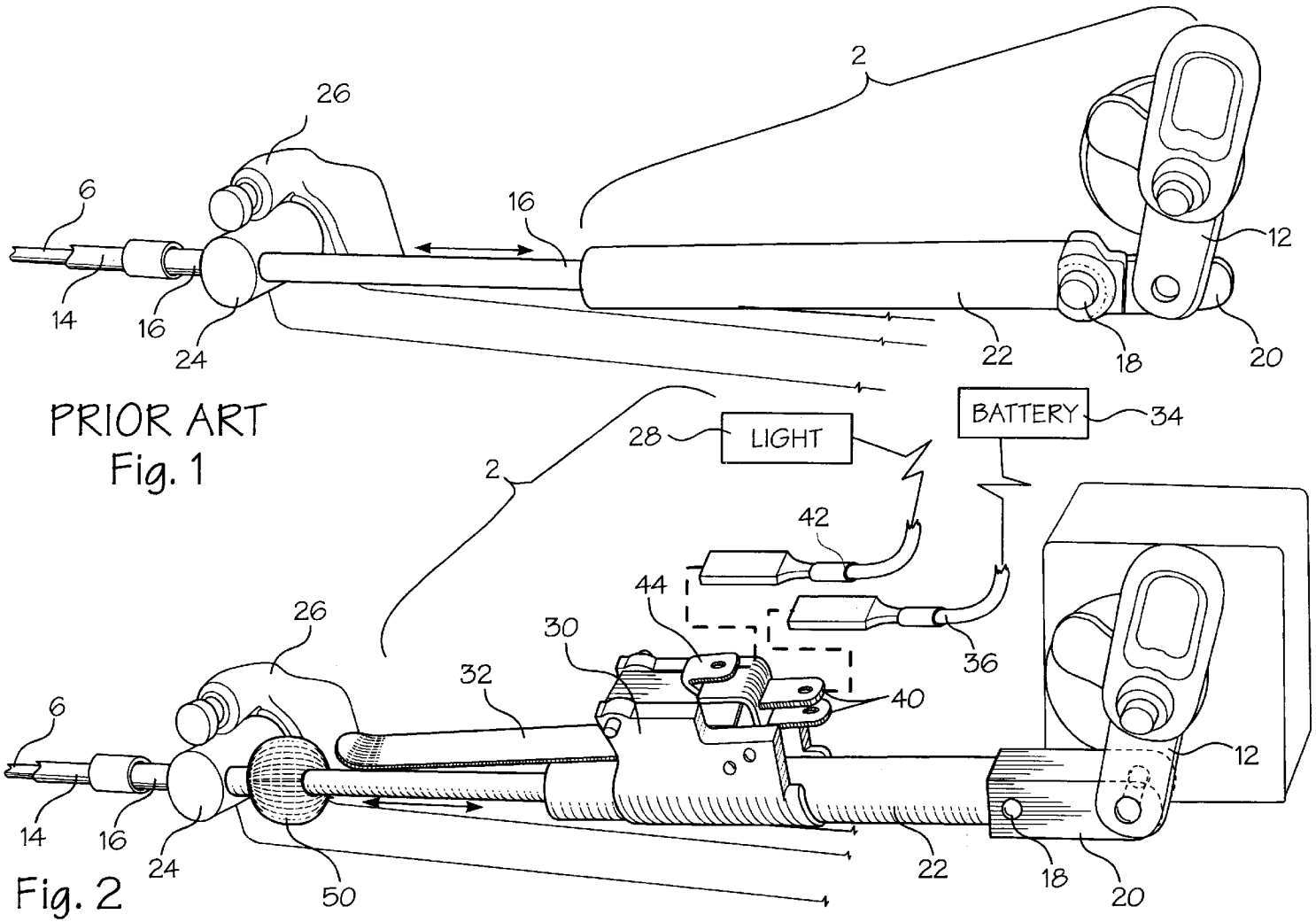
PRIOR ART Fig. 1
FIG. 1 is a perspective view of a prior art throttle control assembly used in outboard marine engines as may be adapted to by the present invention.
FIG. 2 is a perspective view of a control switch of the present invention adapted to a throttle control assembly similar to that in FIG. 1.

Referring now to the drawings, FIG. 1 illustrates an example of a prior art throttle control assembly 2 as would exist on a typical marine outboard motor 4 that is used on small water craft or boats. Such throttle control assemblies come in various designs of similar function. The specific design of the throttle control assembly 2 is not critical in the present invention, except that the throttle control assembly provides a moving throttle mechanism in relation to a portion that is fixed to the interior of an outboard marine engine 4 for adaptation of the present marine brake light system. The prior art throttle control assembly 2 is generally located beneath the cover of an outboard motor and includes a throttle cable 6 that exits the outboard motor 4 and runs from the outboard motor 4 to a throttle control lever 8. The throttle control lever 8 is employed by a boat's operator in controlling the speed and acceleration of a boat.

Both FIG. 1 and FIG. 2 illustrate a typical throttle control assembly 2 of an outboard motor. As shown, the throttle control assembly 2 consists of a cable assembly 10 connected to a throttle link 12 for controlling the outboard motor's throttle (not shown). In turn, the throttle as controlled by the throttle control assembly 2 determines the speed and direction of a boat powered by the outboard motor 4. The cable assembly 10 includes a throttle cable 6 that is contained within a casing 14 and a tube 16. The cable 6 is held by a clamp 18 to a connector 20 that connects the cable assembly 10 to the throttle link 12. The connector 20 is located at the end of a casing guide 22 that adjoins the connector 20 such that the casing 14 and tube 16 slide within the casing guide 22 as the operator of a boat moves the throttle control lever 8 to move the cable 6.

The cable assembly 10 further includes a trunnion 24 that is affixed to the tube 16 and attaches to a retainer 26 on the motor 4. The trunnion 24 is generally a cylindrical part having a receptacle for a portion of the retainer 26. Since the cable 6 is attached to the casing guide 22 via the connector 20, the retained trunnion 24 causes the casing guide 22 and connector 20 to operate the throttle link 12 as the cable 6 is moved. The trunnion 24 and tube 16 remain fixed as the casing guide 22 and connector 20 move. The trunnion 24 may be adjusted to calibrate the operation of the cable assembly 10 in moving the throttle link 12 to control the degree the throttle is opened or closed. Although a trunnion is shown and well known, variations of affixing a throttle control assembly 2 within an outboard motor could be employed without affecting the applicability of the present invention.

Figure 3:
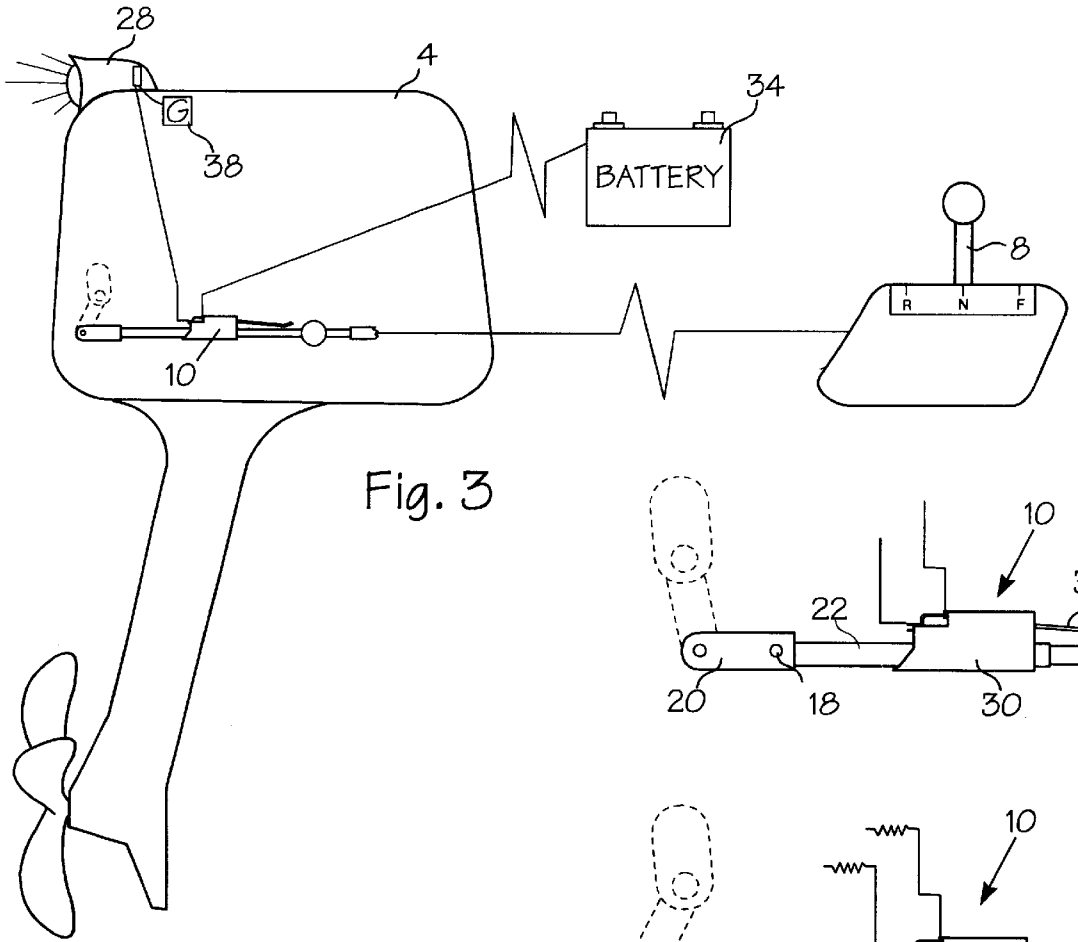
FIG. 3 is a schematic view of the marine brake light system of the present invention with the throttle control lever in neutral position causing the warning light of the invention to be illuminated.

As shown in FIG. 2, the cable assembly 10 in the present marine brake light system is modified such that the operation of the throttle control lever 8 when a boat is slowing or stopped causes a warning light 28 to be activated. In particular, the warning light 28 of the embodiment of the invention as discussed herein is turned on when the throttle control lever 8 of FIG. 3 is in neutral or partially forward position to provide very little propulsion such that the motor 4 would cause a boat stop or to operate at a very slow speed. The present invention may be adapted to provide the same results when the throttle control assembly 2 is operated by a throttle control lever or other control apparatus located on the motor 4 itself, or by some other apparatus such as a foot pedal.

The warning light 28 is shown secured to the top of the outboard motor 4 toward the rear of the motor cover, and the light 28 is facing rearward or aft from the rear face of the outboard motor 4 such that the light 28 is seen by observers behind the motor 4 when the light 28 is illuminated. The device used in attaching the light 28 to the cover may be any suitable bracket or attachment device. Further, the motor cover may be manufactured with an integrated braking light similar to brake lights on automobiles.

When a boat with the present invention installed is operating very slowly, slowing to a stop, or stopped while the motor 4 is operating, the warning light 28 will be illuminated to warn operators of other trailing boats of the leading boat's status. To provide a very conventional look and feel, the warning light 28 may be a very bright red light similar to that used in brake lights for automobiles. The light is intended to illuminate only part of the time while a boat is slowing or stopping and may be timed to cut off after a short period of time. Thereby, the brake warning light 28 should not be confused with the standard lighting required on all boats that indicate a boat's orientation and transmission position. To further avoid such confusion, the present warning light 28 is placed on the cover of an outboard marine engine 4 rather than on the stern of the water craft, although the brake warning light could be adapted to very small craft, such as jet skis, with the warning light mounted on the body of the craft.

The cable assembly 10 as modified by the present invention includes a switch 30 that closes an electrical circuit when triggered to provide power to the warning light 28. The switch 30 is triggered by movement of a lever 32 that is connected to the switch 30. A battery 34 may connect via a wire 36 and a ground 38 to the switch 30 by one or more terminals 40 to provide the electric current for the warning light 28. The warning light 28 is connected via a wire 42 to the switch 30 via an output terminal 44 on the switch 30 as shown in FIG. 2.

Figure 4:
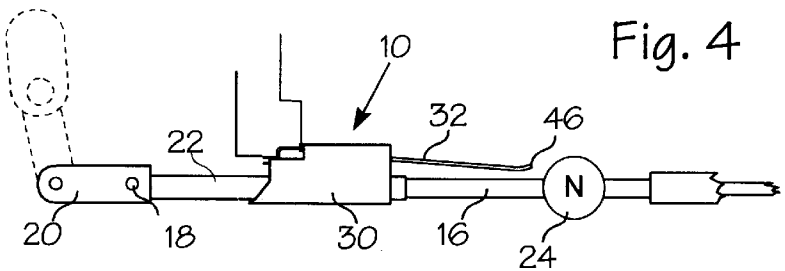
FIG. 4 is a side elevational view of the control switch of the present invention adapted to a throttle control assembly and shown in position where a throttle control lever operating the throttle is in neutral position.
Figure 5:
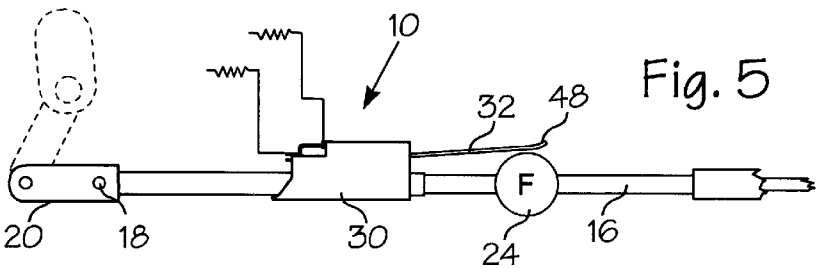
FIG. 5 is a side elevational view of the control switch of the present invention adapted to a throttle control assembly and shown in position where a throttle control lever operating the throttle is in forward position.

The lever 32 extends away from the switch 30 toward the trunnion 24. FIG. 4 and FIG. 5 show the actuation of the switch 30 dependent upon the condition of the lever 32. Referring to FIG. 4, the lever 32 is shown in a down position 46 in which the trunnion 24 does not contact the lever 32, and the switch 30 is actuated causing the warning light 28 to turn on and illuminate. When the lever 32 is in the down position 46 the boat's throttle will ordinarily be closed and in neutral or only partially open to provide only a small amount of thrust for slow forward movement of the boat. Referring to FIG. 5, as the boat's throttle is opened further to provide greater forward thrust, the lever 32 will contact the trunnion 24. As the lever 32 contacts the trunnion 24, the lever 32 is moved into an up position 48. The movement of the lever 32 into the up position 48, deactivates the switch 30 causing the warning light 28 to turn off.

In lieu of the trunnion 24 that attaches to the retainer 26, a supplementary trunnion type device 50 or a raised section incorporated onto the tube 16 of the cable assembly 10 may be provided to contact the lever 32 and cause the movement of the lever 32 into the up position 48. As discussed above, the switch 30 and lever 32 may be modified to work with various designs of the throttle control assemblies 2 while still being within the intended scope of the present invention. Further, the lever 32 may be modified as needed, for instance by shortening it, to accommodate any such alternative trunnion device 50 for displacing the lever 32. Even further, an alternative position sensing device may be substituted in lieu of the lever 32. The sensing device would actuate the switch when the position of the throttle control assembly 2 reached the near-neutral or neutral position.

From the foregoing description of the illustrative embodiments of the invention, it will be apparent that many modifications may be made therein. It should be understood therefore that these embodiments of the invention are intended as an exemplification of the invention only and that the invention is not limited thereto. Therefore, it is intended that the claims are to cover all such modifications that will fall within the true spirit and scope of the invention.

I claim:

1. A marine warning light system for a water craft having an engine comprising:

a. a warning light facing aft and secured on the rear of the craft;

b. a mobile throttle control assembly affixed in the engine for controlling the speed of the water craft;

c. a switch adapted to the throttle control assembly;

d. a position sensing device to provide feedback from the throttle control assembly to the switch and causing the switch to activate and close a circuit from a power source to energize the warning light upon the throttle control assembly moving a predetermined amount to slow or stop the water craft.

2. A marine warning light system for a motorboat having an outboard marine engine comprising:

a. a warning light facing aft and secured to the outboard marine engine;

b. a mobile throttle control assembly affixed in the outboard marine engine for controlling the speed of the motorboat;

c. a switch adapted to the throttle control assembly;

d. a position sensing device to provide feedback from the throttle control assembly to said switch and causing said switch to activate and close a circuit from a power source to energize the warning light upon the throttle control assembly moving a predetermined amount to slow or stop the motorboat.

3. A marine warning light system as in claim 2 in which said position sensing device includes a lever having a down position in which said switch is activated and an up position in which said switch is deactivated.

4. A marine warning light system as in claim 3 in which said lever is moved into said up position by a trunnion device that is attached to said throttle control assembly.

5. A marine warning light system as in claim 3 in which said lever is moved into said up position by said trunnion device when said throttle control assembly moves near or into a neutral operating position.

6. A method of warning boats in the vicinity behind a motorboat that the motorboat is slowing or stopping, comprising the steps of:

a. providing aft facing warning light secured to an outboard marine engine;

b. connecting the aft facing warning light to a switch;

c. connecting the switch to a power source by a circuit;

d. sensing the position of a mobile throttle control assembly that is affixed in the outboard marine engine for controlling the speed of the motorboat;

e. causing the switch to activate and close the circuit from the power source and energizing the warning light upon the throttle control assembly moving a predetermined amount to slow or stop the motorboat.

* * * * *